United States Patent [19]

Todd

[11] 4,333,562

[45] Jun. 8, 1982

[54] CAPSULE FOR STORING WRITTEN INFORMATION

[76] Inventor: Michael A. Todd, 1121 Hacienda Blvd., Hacienda Heights, Calif. 91745

[21] Appl. No.: 230,315

[22] Filed: Feb. 2, 1981

[51] Int. Cl.[3] ..... A45C 11/00; B65D 83/00

[52] U.S. Cl. ..... 206/37; 206/232; 206/534

[58] Field of Search ..... 206/534, 37, 38, 39, 206/232

[56] References Cited

U.S. PATENT DOCUMENTS

| | | | |
|---|---|---|---|
| 1,856,619 | 5/1932 | Carsey | 206/37 |
| 2,232,333 | 2/1941 | McGehee | 206/232 |
| 3,958,690 | 5/1976 | Gee, Sr. | 206/232 |

*Primary Examiner*—William T. Dixson, Jr.
*Attorney, Agent, or Firm*—Kit M. Stetina

[57] ABSTRACT

A body member has a cavity with an opening adapted and constructed to receive a plug member in sealed engagement therewith, the plug member having a chamber which opens into the cavity when the plug member is engaged in the opening of the cavity, the chamber in the plug member being constructed and adapted to receive and hold a substantial portion of the length of a roll of paper containing written information such that when the plug is secured in the opening in the cavity of the body member the chamber and its contents are enclosed without restriction and protected by the body member and when the plug member is removed from the body member the chamber and its contents are exposed and readily accessible for removal and examination of the contents.

5 Claims, 4 Drawing Figures

CAPSULE FOR STORING WRITTEN INFORMATION

The present invention relates to small pocket sized containers and more particularly to a capsule for personal storage of written information.

In the field of containers for storing written information on the person of an individual, it has been the practice to use wallets, purses, lockets and small pocket sized containers into which the written information is inserted for storage and safekeeping. Although such devices have served the purpose, they have not proved entirely satisfactory under all conditions of service for the reason that considerable difficulty has been experienced in removing the written material from its enclosure for examination. Purses, wallets and lockets generally store the desired written material in a flat, narrow pocket where it is wedged in a flat, folded configuration, making it difficult to remove. Furthermore, the desired material may be interleaved with other undesired material, making it difficult to isolate. Containers such as cylinders with caps offer a protective enclosure for rolled written information but it is next to impossible to withdraw the written information due to the unrolling of the material against the interior walls of the container thereby restricting and resisting removal.

Those concerned with the storage of emergency medical information on the person of an individual having long recognized the need for a storage device which is easily located on the person and in which the written emergency medical information is readily accessible and rapidly removable for examination. The present invention fulfills this need.

The general purpose of this invention is to provide a capsule for storing written information on the person of an individual which embraces all the advantages of similarly employed pocket or purse sized enclosures and possesses none of the afore-described disadvantages. To attain this, the present invention contemplates a unique arrangement of a body member with an internal cavity and a sealing plug member with a chamber for receiving and holding a substantial length of a roll of written material whereby the difficulty of removing the written material from storage within the combination is avoided.

An object of the present invention is the provision of a small container for the storage of written information from which the material upon which the written information is contained is easily removable for examination.

Another object of the present invention is to provide a closure for a container of written material where the closure securely holds the written material for easy removal from the container and for easy access after removal.

Yet another object of the present invention is the provision of a housing member with a plug for grasping and holding a roll of written emergency medical information in unrestricted containment within the housing member.

Other objects and many of the attendant advantages of this invention will be readily appreciated as the same becomes better understood by reference to the following detailed description when considered in connection with the accompanying drawings in which like reference numerals designate like parts throughout the figures thereof and wherein.

Figure 1:
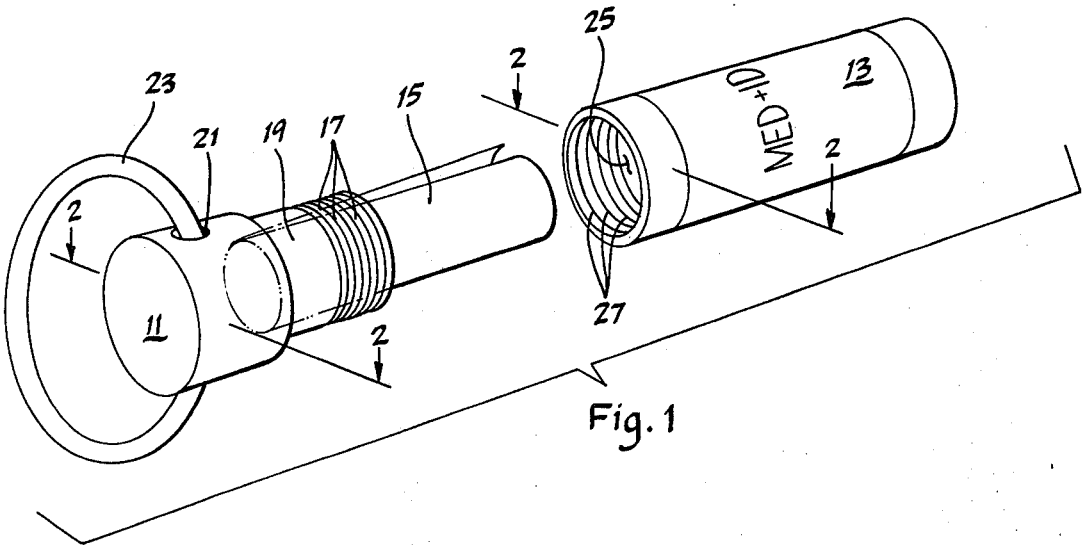
FIG. 1 shows an exploded perspective view of a preferred embodiment of the invention.

Referring now to the drawings, wherein like reference characters designate like or corresponding parts throughout the several views, there is shown in FIG. 1 (which illustrates a preferred embodiment) an elongated closure, cylindrical insert, or plug member 11 for closing and sealing a body member, thin walled cylinder, or housing member 13. Plug member 11 has a chamber, cylindrical bore, or central cavity (not visible) substantially along the length thereof into which a substantial portion of the length of a roll of paper 15 containing written information thereon is inserted. The end of plug member 11 adjacent the chamber opening into which a rolled paper 15 is inserted contains threads 17 therearound. The other end of plug 11 has a cylindrical head section 19 through which a hole or passage 21 is located along a diameter thereof. A ring 23 is moveably engaged in hole 21. Body member 13 has an open hollow interior or cavity 25 therein with the interior surface adjacent the opening thereinto containing a set of threads 27 therearound.

Figure 2:
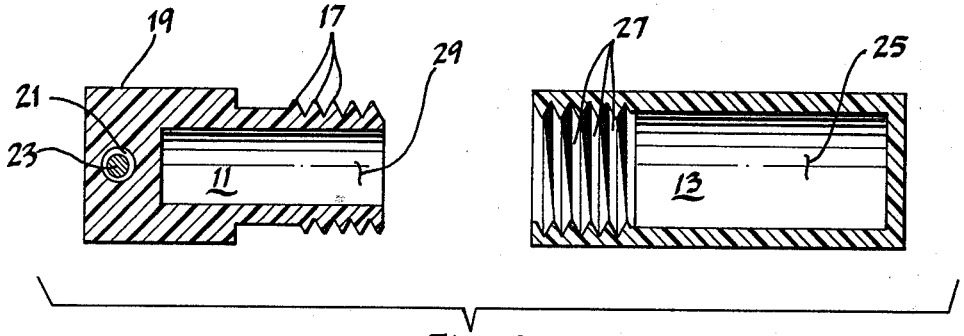
FIG. 2 illustrates a cross-section of the device taken on the lines 2—2 of FIG. 1 looking in the direction of the arrows.

FIG. 2 illustrates body member 13 and plug member 11 in section taken along the lines 2—2 in the direction of the arrows of FIG. 1. Plug member 11 has a central cavity, chamber, or bore 29 substantially along the length thereof, open at one end and closed at the other end by head section 19 through which ring 23 passes in hole or passage 21. A set of threads 17 are located on the exterior surface of plug member 11 adjacent the opened end of chamber 29. Body member 13 is a thin-walled cylinder closed at one end and open at the other to form cavity 25 with threads 27 adjacent the open end thereof.

Figure 3:
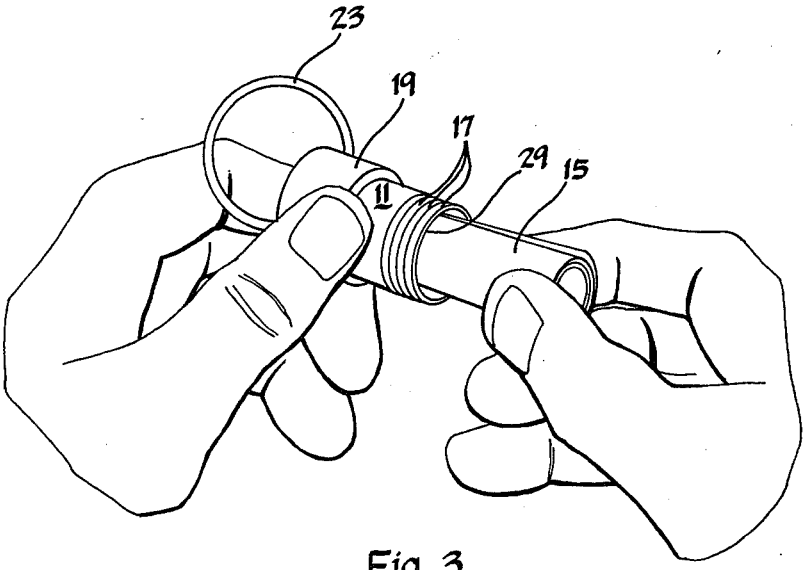
FIG. 3 shows a perspective view of the plug member of the device held in the fingers of a person about to examine the contents thereof.

FIG. 3 illustrates how plug member 11 may be grasped and held by the fingers of an individual in preparation for examination of the contents of rolled paper 15. Head section 19 is shown secured between the thumb and index finger of the left hand with ring 23 being rotated to a position so as not to obstruct the fingers. Rolled paper 15 is shown grasped between the thumb and index finger of the right hand in anticipation of removal. It is noted that a substantial portion of the length thereof is still contained and securely held in chamber 29 of plug 11.

Figure 4:
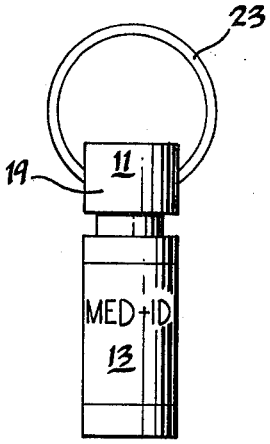
FIG. 4 illustrates a side elevation of the assembled device shown in FIG. 1.

FIG. 4 shows the complete assembly of plug 11 in body member 13 with ring 23 passing through head section 19.

Operation of the invention may be described by first referring to FIG. 3. Rolled paper 15 containing written information such as emergency medical information pertaining to an individual is tightly rolled and a substantial portion of the length thereof is inserted into cavity 29 of plug member 11 until the end of rolled paper 15 reaches the closed end of chamber 29. Since plug member 11 is an elongated plug, the length of chamber 29, which substantially traverses the length of plug member 11, is sufficient to frictionally engage and securely hold the length of rolled paper 15 secured therein. The spring like tendency of rolled paper 15 to unroll further secures rolled paper 15 within chamber 29. However, the portion of rolled paper 15 still exposed and not contained within chamber 29 is easily grasped between the thumb and index finger and either inserted or removed from chamber 29 with little effort. This makes the written information readily accessible for examination.

Turning now to FIG. 1, once rolled paper 15 is inserted into chamber 29, plug 11 may be inserted into hollow interior or cavity 25 of body member 13 where rolled paper 15 is enclosed and contained without restriction or resistive engagement with the walls of cavity 25. After insertion into cavity 25, plug member 11 is then turned to engage threads 17 of plug member 11 with threads 27 of body member 13 to tightly and securely screw plug member 11 into cavity 25 of body member 13. Once plug member 11 is threadably sealed into body member 13, rolled paper 15 with emergency medical information thereon is contained and protected within the assembled capsule held only by plug member 11. The complete assembly as illustrated in FIG. 4 may be attached to the person of an individual by a chain, tether, hook or clip which engages ring 23.

In time of emergency, where the individual wearing the capsule containing the emergency medical information may be unconscious, anyone giving first aid may easily locate the capsule on the individual and unscrew plug 11 from body member 13 and unrestrictedly remove rolled paper 15 securely held in plug member 11 from body member 13. Then as shown in FIG. 3, rolled paper 15 is exposed and may be easily and rapidly removed from plug member 11 for examination of the emergency medical information contained thereon. It is to be noted that body member 13 does not restrict or hold rolled paper 15 and therefore it is easily inserted and removed from body member 13 and further, since plug member 11 holds rolled paper 15 and is substantially exposed in plug member 11, rolled paper 15 is accessible for rapid removal and examination.

Although plug member 11 is illustrated as being threaded into body member 13, it is contemplated that plug member 11 may have a tapered smooth surface instead of threads to engage a matching tapered smooth surface instead of threads in cavity 25 of body member 13 thereby forming a wedge like surface engagement to seal and securely hold plug member 11 in body member 13. Further sealing elements may be used such as gaskets and O-rings.

It now should be apparent that the present invention provides a mechanical arrangement which may be employed in conjunction with a capsule or container for holding and protecting written information such that the written information is readily accessible and easily removed from the capsule.

Although particular components, etc., have been discussed in connection with a specific embodiment of a capsule or container constructed in accordance with the teachings of the present invention, others may be utilized. Furthermore, it will be understood that although an exemplary embodiment of the present invention has been disclosed and discussed, other applications and mechanical arrangements are possible and that the embodiments disclosed may be subjected to various changes, modifications and substitutions without necessarily departing from the spirit of the invention.

What is claimed is:

1. A device for containing and protecting medical information upon a user to permit easy access and examination of said information in an emergency situation comprising:

a body member having a cavity therein, said cavity having an opening therein, said opening being constructed and adapted to receive a plug member in releasably sealed engagement therewith;

a roll of paper adapted to contain written medical information pertaining to said user; and a plug member having a chamber therein; said chamber opening into said cavity when said plug member is engaged in said opening, said chamber being sized to tightly receive and securely retain one end of said roll of paper such that when said plug member is secured in said opening, the chamber and said roll of paper are unrestrictedly enclosed and protected by said body member and when said plug member is removed from said opening, said roll of paper is withdrawn from said body member and exposed and readily accessible so that said roll of paper may be easily removed from said plug member and examined.

2. The device described in claim 1 wherein said body member is a thin-walled cylinder closed at one end and open at the other and wherein said plug member is a cylindrical insert and said chamber is a cylindrical bore centrally located in said cylindrical insert and substantially extending along the length thereof with one end of said cylindrical bore being closed and the other end being open.

3. The device described in claim 2 wherein said open end of said cylinder is threaded around the interior thereof and said cylindrical insert is threaded around the exterior thereof adjacent said open end of said cylindrical bore, said cylindrical insert being threadably engaged with said cylinder to seal said cylinder with said cylindrical insert.

4. The device described in claim 3 further including a ring engaged in a passage through said cylindrical insert adjacent said closed end of said bore whereby the device may be secured to the person of an individual by engaging said ring with a securing tether.

5. A device for containing medical information upon a user to permit easy access and examination of said information in an emergency situation comprising:

a housing member having a cylindrical shape and a hollow interior with one end closed and the other end open, said housing member having threads around the interior of said open end;

a roll of paper adapted to contain written medical information pertaining to said user;

an elongate plug member having a cylindrical shape and a central cavity substantially along the length thereof, said cavity being closed at one end of said elongated plug member and open at the other end thereof, said elongated plug member having threads around the exterior thereof adjacent the open end formed to engage the threads of said housing member and said central cavity sized to tightly receive one end of said roll of paper therein and securely retain said roll of paper relative said plug member; said elongated plug member adapted to be initially threaded into said housing member to protect and contain said roll of paper without restriction within said hollow interior of said housing member and subsequently be threadably removed from said housing member in time of emergency whereby said roll of paper is automatically withdrawn from said hollow interior of said housing member and exposed for easy removal from said plug member and examination; and means coupled to said elongate plug member for attaching said elongate plug member and said housing member threadably engaged therewith to a desired location upon said user.

* * * * *